US011796265B2

(12) United States Patent
Vaughan et al.

(10) Patent No.: US 11,796,265 B2
(45) **Date of Patent: *Oct. 24, 2023**

(54) LOCKING ACTION FIREARM

(71) Applicant: Franklin Armory Holdings, Inc., Minden, NV (US)

(72) Inventors: Grant Vaughan, Carson City, NV (US); David Michael Gockel, Carson City, NV (US)

(73) Assignee: FRANKLIN ARMORY HOLDINGS, INC., Minden, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/838,700

(22) Filed: Jun. 13, 2022

(65) Prior Publication Data

US 2022/0316829 A1 Oct. 6, 2022

Related U.S. Application Data

(63) Continuation-in-part of application No. 17/587,156, filed on Jan. 28, 2022, now Pat. No. 11,466,951.
(Continued)

(51) Int. Cl.
*F41A 3/26* (2006.01)
*F41A 19/10* (2006.01)
*F41A 3/72* (2006.01)

(52) U.S. Cl.
CPC *F41A 3/26* (2013.01); *F41A 3/72* (2013.01); *F41A 19/10* (2013.01)

(58) Field of Classification Search
CPC ..... F41A 17/62; F41A 17/46; F41A 17/48; F41A 17/56; F41A 17/58; F41A 17/42;
(Continued)

(56) References Cited

U.S. PATENT DOCUMENTS 4,176,584 A * 12/1979 Thomas, Jr. ..... F41A 17/38 89/196
5,042,185 A * 8/1991 Justice, Sr. ..... F41A 17/74 42/70.11

(Continued)

FOREIGN PATENT DOCUMENTS

WO WO-9410524 A1 * 5/1994 ..... F41A 19/12

OTHER PUBLICATIONS

Heckler & Koch, "Mark 23," https://hk-usa.com/hk-models/mark-23/, accessed Feb. 24, 2022.

(Continued)

*Primary Examiner* — John Cooper
(74) *Attorney, Agent, or Firm* — Bennet K. Langlotz; Langlotz Patent & Trademark Works, LLC

(57) ABSTRACT

A locking action firearm has a frame, a barrel connected to the frame, a reciprocating action element operable to reciprocate with respect to the frame between a forward battery position and a rear recoil position, a trigger lever connected to the frame and movable between a forward released position and rear actuated position, and a block element movable between a rest position in which movement of the reciprocating action element from the battery position to the recoil position is enabled, and a blocking position in which the block element contacts the reciprocating action element to prevent movement of the reciprocating action element from the forward battery position to the recoil position in response to movement of the trigger lever to discharge the firearm. The block element may be operably connected to the trigger lever and move based on the trigger lever position.

13 Claims, 9 Drawing Sheets

Related U.S. Application Data

(60) Provisional application No. 63/147,360, filed on Feb. 9, 2021.

(58) Field of Classification Search
CPC ..... F41A 19/06; F41A 19/10; F41A 19/12; F41A 19/24; F41A 3/64; F41A 3/68; F41A 3/70; F41A 5/14; F41A 5/24; F41A 9/23; F41A 9/52
USPC ..... 42/70.05
See application file for complete search history.

(56) References Cited

U.S. PATENT DOCUMENTS

| | | | | |
|---|---|---|---|---|
| 6,314,859 | B1 * | 11/2001 | Weichert | F41A 3/86 42/1.06 |
| 10,378,838 | B2 * | 8/2019 | Hopkins | F41A 3/42 |
| 11,168,952 | B2 * | 11/2021 | Palkow | F41A 21/30 |
| 2019/0086169 | A1 * | 3/2019 | Hopkins | F41A 3/68 |

OTHER PUBLICATIONS

Wikipedia, "SIG Sauer System," https://en.wikipedia.org/wiki/SIG_Sauer_System, accessed Apr. 15, 2022.

* cited by examiner

LOCKING ACTION FIREARM

CROSS-REFERENCE TO RELATED APPLICATION

This application is a Continuation-in-Part of U.S. patent application Ser. No. 17/587,156 filed on Jan. 28, 2022, entitled "CONDITIONAL LOCKING MECHANISM FOR HANDGUNS, which claims the benefit of U.S. Provisional Patent Application No. 63/147,360 filed on Feb. 9, 2021, entitled "CONDITIONAL LOCKING MECHANISM FOR HANDGUNS," which are hereby incorporated by reference in their entirety for all that is taught and disclosed therein.

FIELD OF THE INVENTION

The present invention relates to firearms, and more particularly to a locking action firearm that enables the slide and barrel to be conditionally locked to prevent semiautomatic action.

BACKGROUND AND SUMMARY OF THE INVENTION

Most semiautomatic pistols use a short recoil mechanism where the barrel and slide recoil together momentarily and separate when the barrel is redirected downward by a pin or locking block to unlock it from the slide, which continues recoiling. In certain scenarios, it can be advantageous or even necessary to lock the slide and barrel assembly to prevent semi-automatic action. Because the slide needs to be actuated to load a cartridge into the chamber and to unload the fired shell, any locking mechanism would have to be selectable or conditional. One beneficial condition for this locking to occur is when the trigger must be pulled. This will lock the barrel and slide in battery when the firearm is discharged and unlock it when the trigger is released to permit the manual cycling of the weapon.

An additional application for a conditional locking mechanism is for use with an external selector lever. The selector lever can serve to activate or deactivate the locking mechanism so that, when the selector lever is active and the trigger is pulled, the slide and barrel assembly are locked, but when the selector lever is deactivated and the trigger is pulled, the weapon functions in a semi-automatic manner, and the locking mechanism is disengaged. This design has a practical application for use in combination with sound reduction devices by avoiding the sound of the slide and action cycling.

A device that serves a similar purpose is present on the HK Mark 23 pistol manufactured by Heckler & Koch of Columbus, Ga. It allows the user to lock the slide and unlock the slide, but this requires a separate motion and remains locked after the shot has been fired until it is manually unlocked. The conditional locking mechanism locks the slide automatically when the trigger is pulled and unlocks it when the trigger is released. Both require the slide to be manually operated.

Therefore, a need exists for a new and improved locking action firearm that locks the slide to prevent semi-automatic function when the trigger is pulled. The addition of this technology serves two purposes: it prevents semi-automatic function for use in restrictive jurisdictions, and it eliminates action noise when used with a sound reduction device. In this regard, the various embodiments of the present invention substantially fulfill at least some of these needs. In this respect, the locking action firearm according to the present invention substantially departs from the conventional concepts and designs of the prior art, and in doing so provides an apparatus primarily developed for the purpose of locking the slide to prevent semi-automatic function when the trigger is pulled.

The present invention provides an improved locking action firearm, and overcomes the above-mentioned disadvantages and drawbacks of the prior art. As such, the general purpose of the present invention, which will be described subsequently in greater detail, is to provide an improved locking action firearm that has all the advantages of the prior art mentioned above.

To attain this, the preferred embodiment of the present invention essentially comprises a frame, a barrel connected to the frame, a reciprocating action element operable to reciprocate with respect to the frame between a forward battery position and a rear recoil position, a trigger lever connected to the frame and movable between a forward released position and rear actuated position, and a block element movable between a rest position in which movement of the reciprocating action element from the battery position to the recoil position is enabled, and a blocking position in which the block element contacts the reciprocating action element to prevent movement of the reciprocating action element from the forward battery position to the recoil position in response to movement of the trigger lever to discharge the firearm. The block element may be operably connected to the trigger lever and move based on the trigger lever position. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
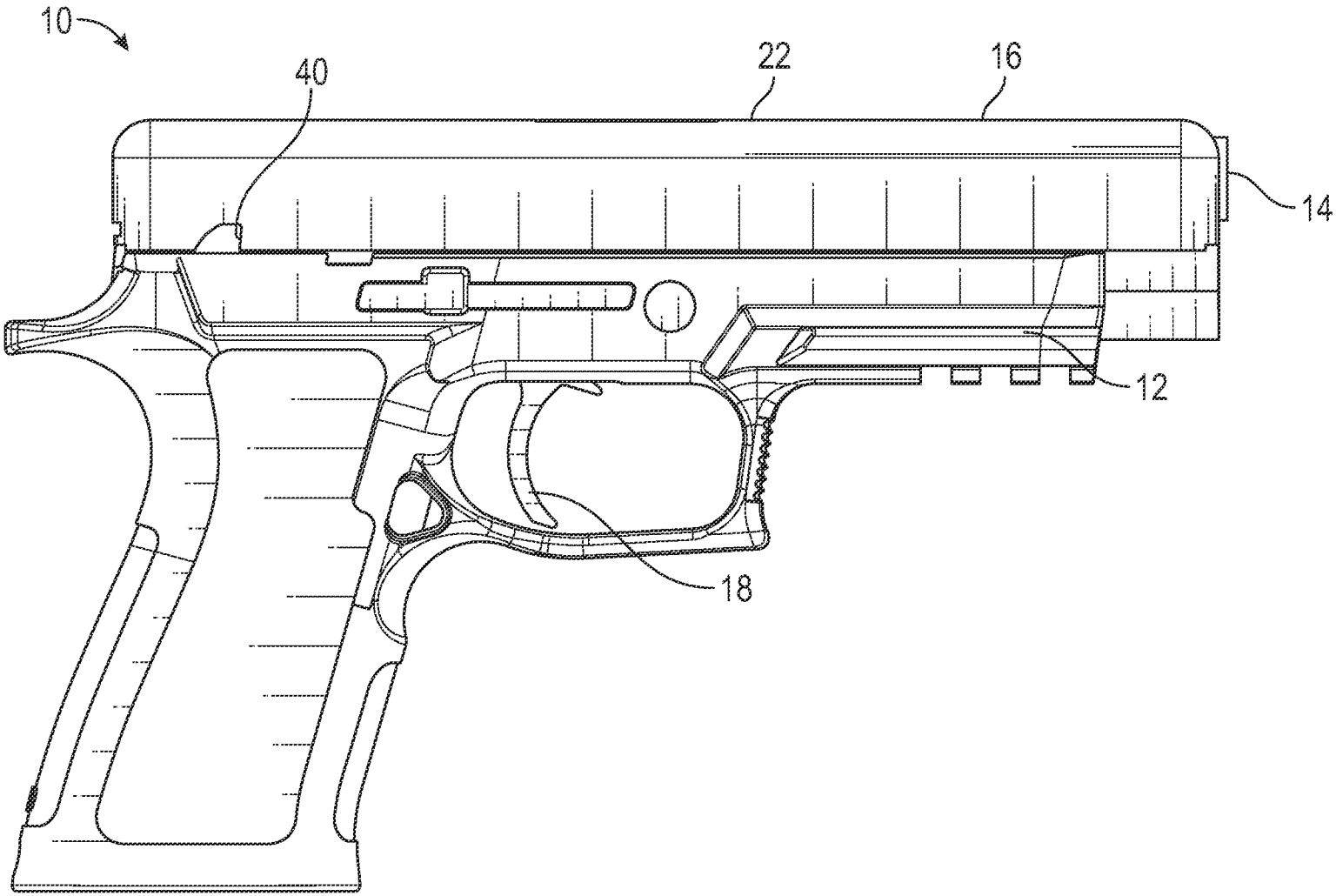
FIG. 1 is a right side view of the current embodiment of a locking action firearm constructed in accordance with the principles of the present invention.

An embodiment of the locking action firearm of the present invention is shown and generally designated by the reference numeral 10.

Figure 2:
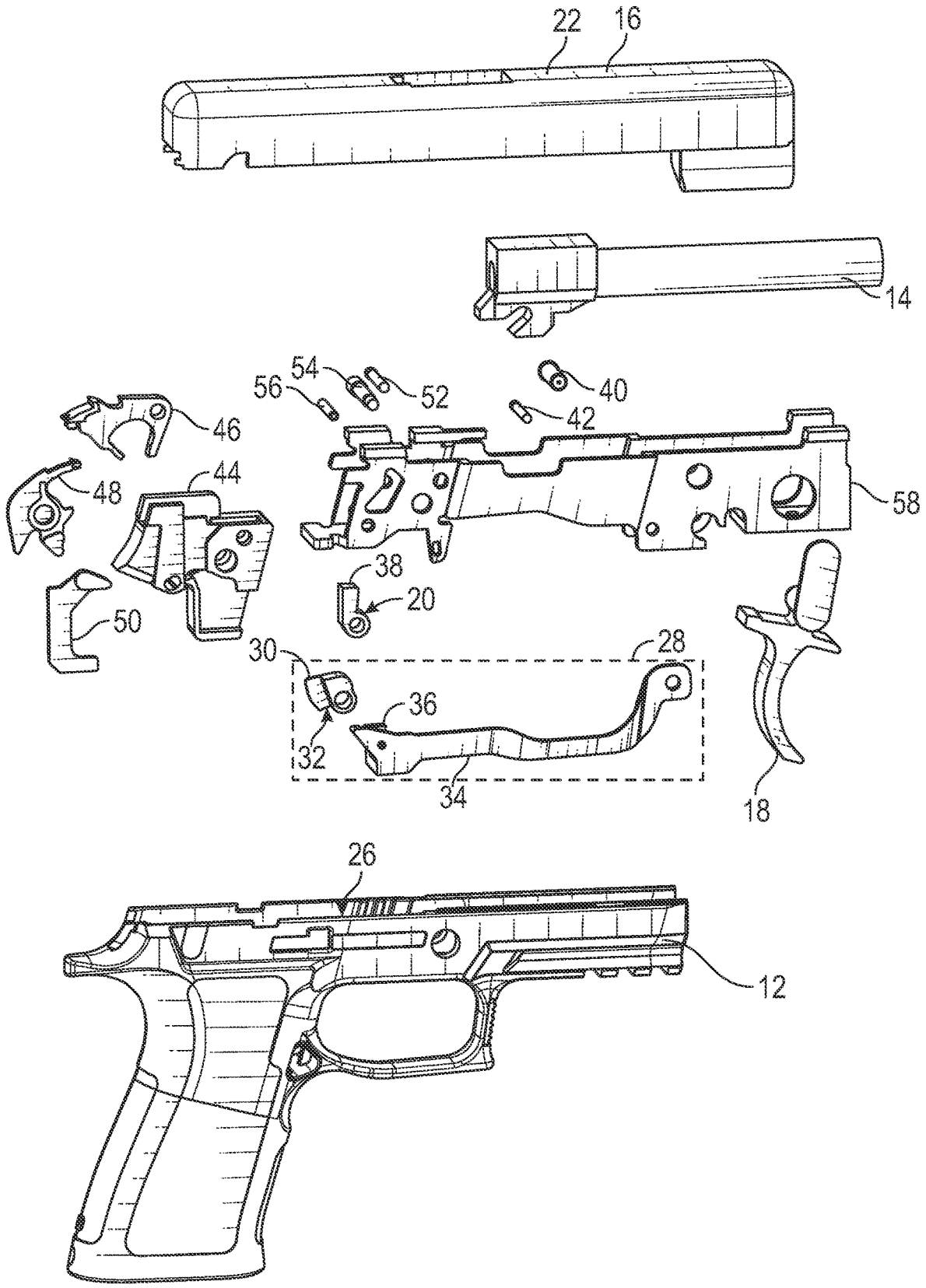
FIG. 2 is an exploded view of the locking action firearm of FIG. 1.
Figure 3:
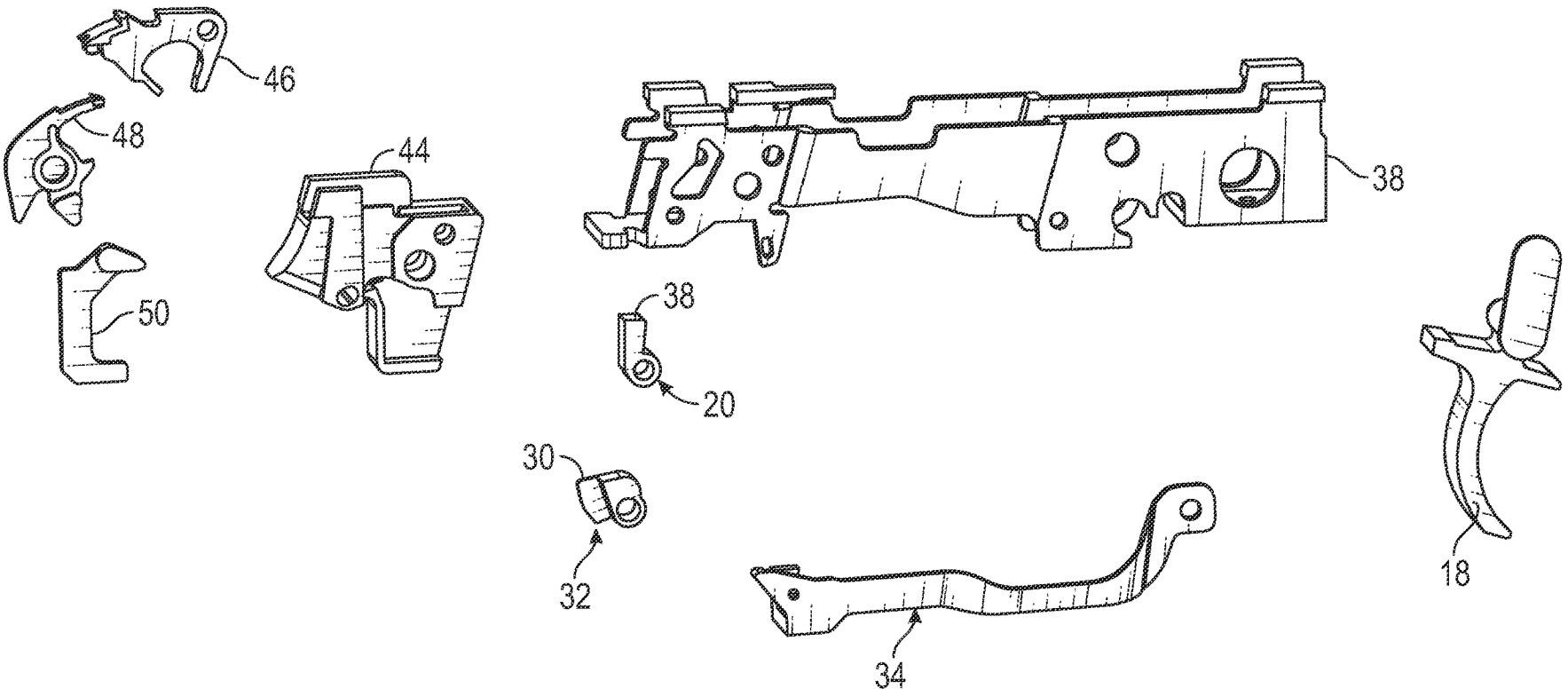
FIG. 3 is an exploded view of the fire control components of the locking action firearm of FIG. 1.
Figure 4:
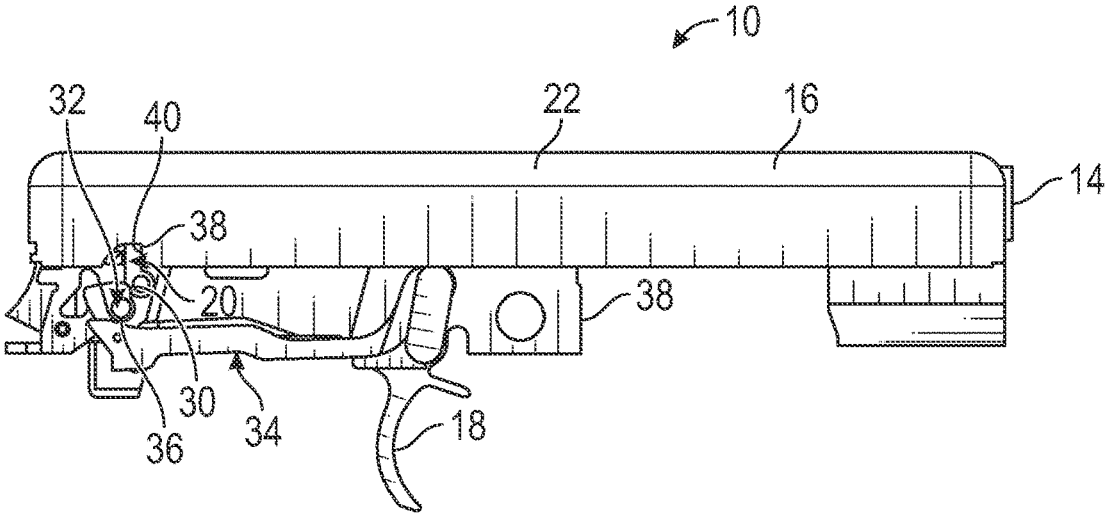
FIG. 4 is a right side view of the locking action firearm of FIG. 1 with the frame removed.
Figure 5:
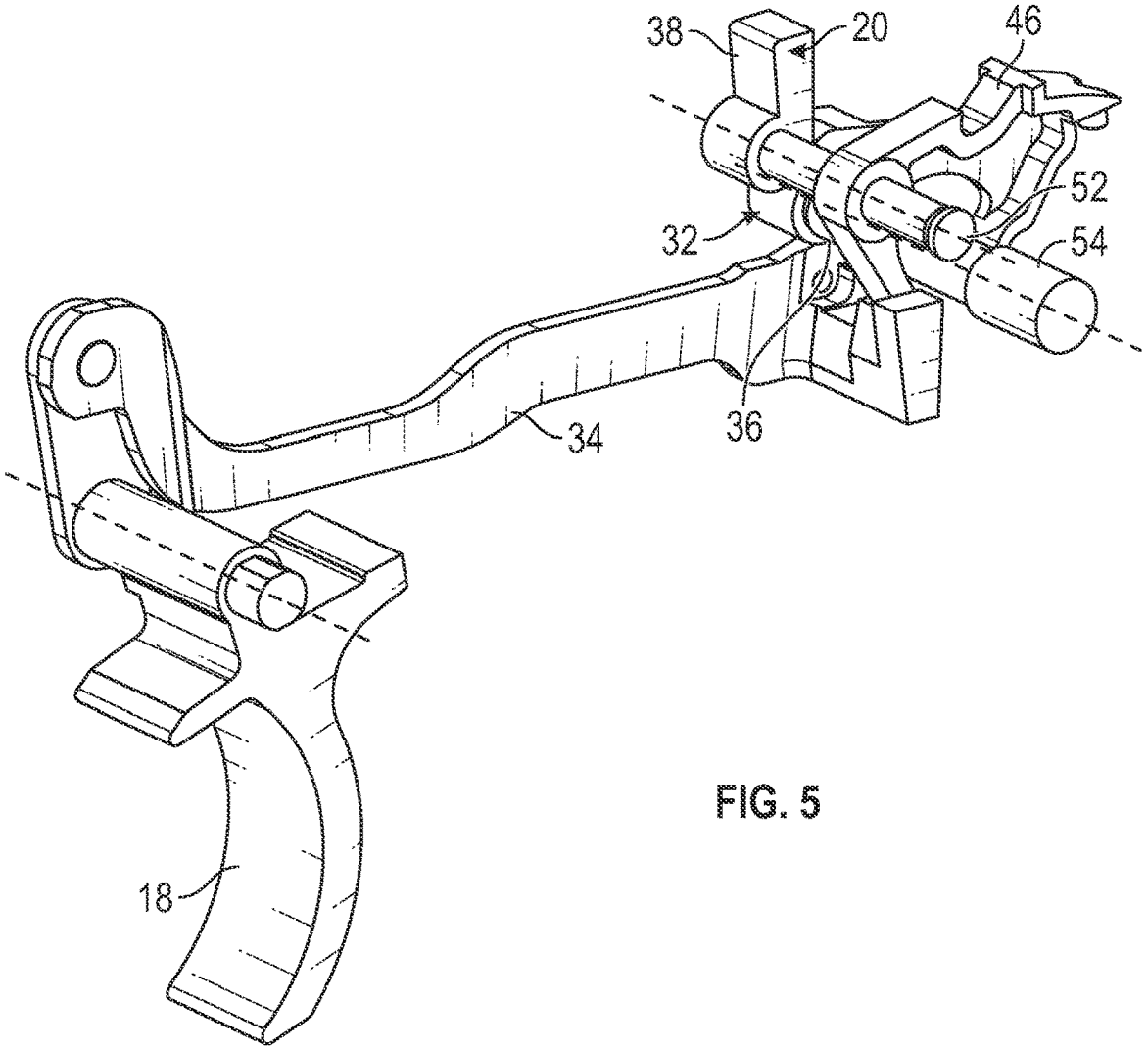
FIG. 5 is a top perspective view of the fire control components of the locking action firearm of FIG. 1 with the fire control unit and sear housing removed.
Figure 6:
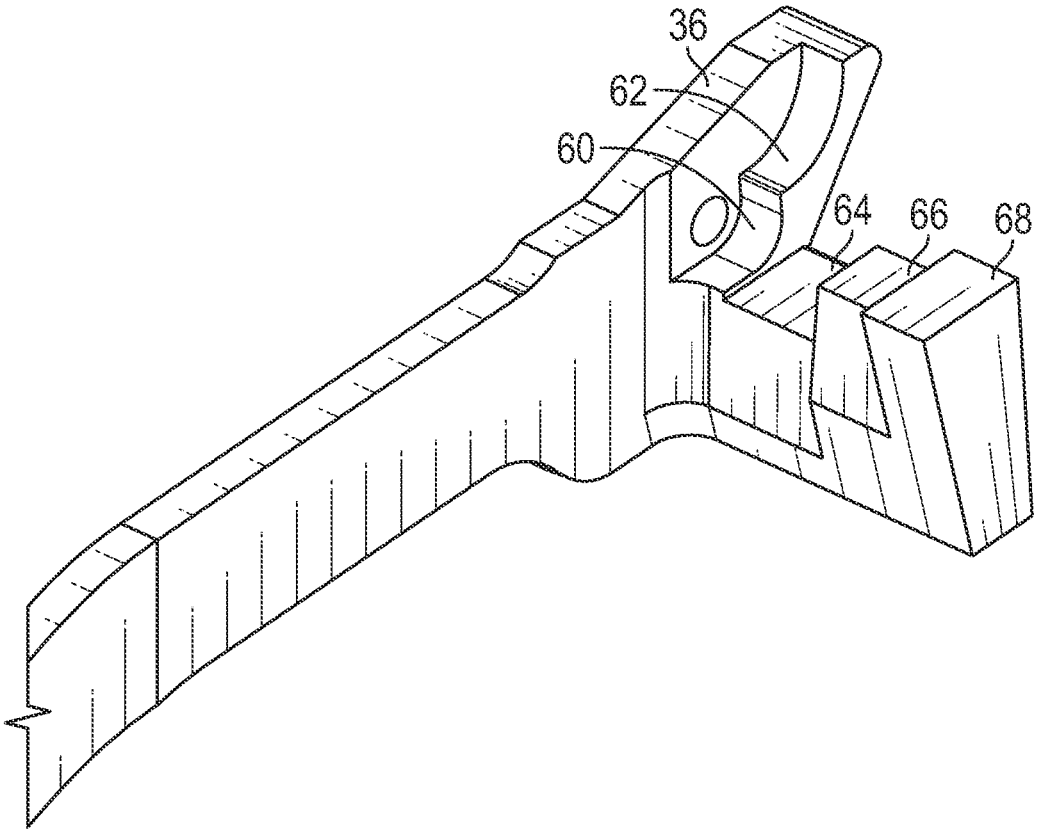
FIG. 6 is a top perspective partial enlarged view of the trigger bar of the locking action firearm of FIG. 1.
Figure 7A:
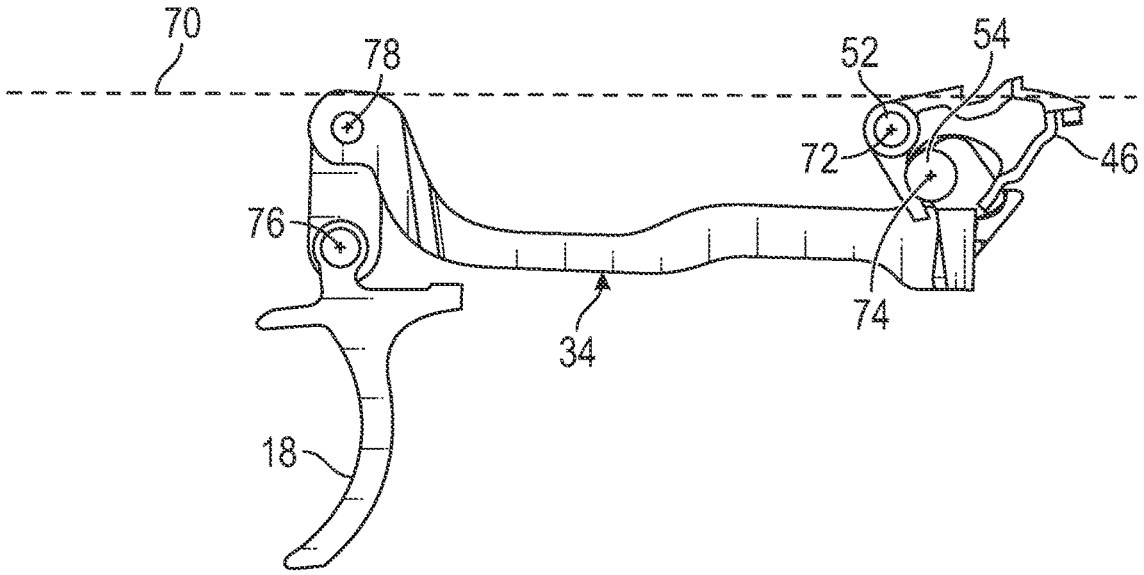
FIG. 7A is a left side view fire control components of the locking action firearm of FIG. 1 with the fire control unit and sear housing removed with the trigger in the rest position.
Figure 7B:
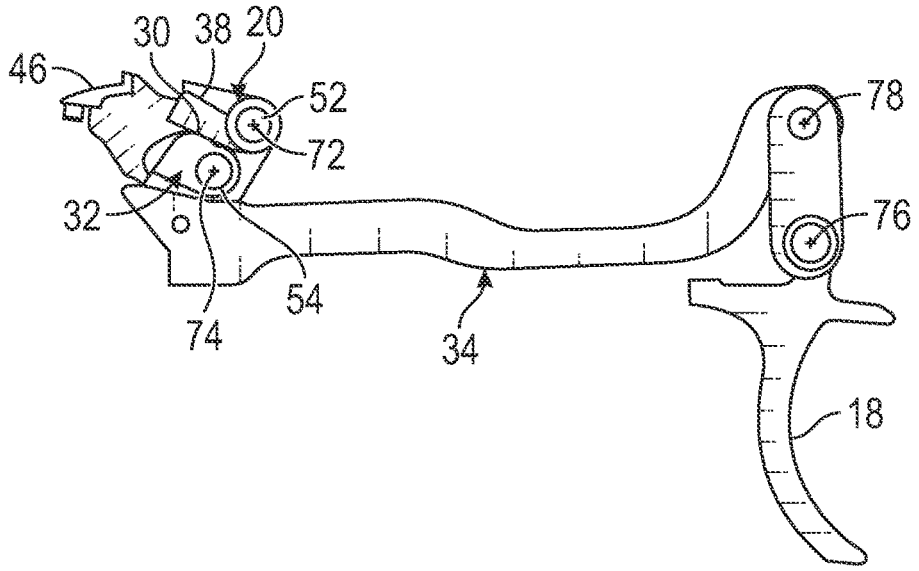
FIG. 7B is a right side view fire control components of the locking action firearm of FIG. 1 with the fire control unit and sear housing removed with the trigger in the rest position.
Figure 8A:
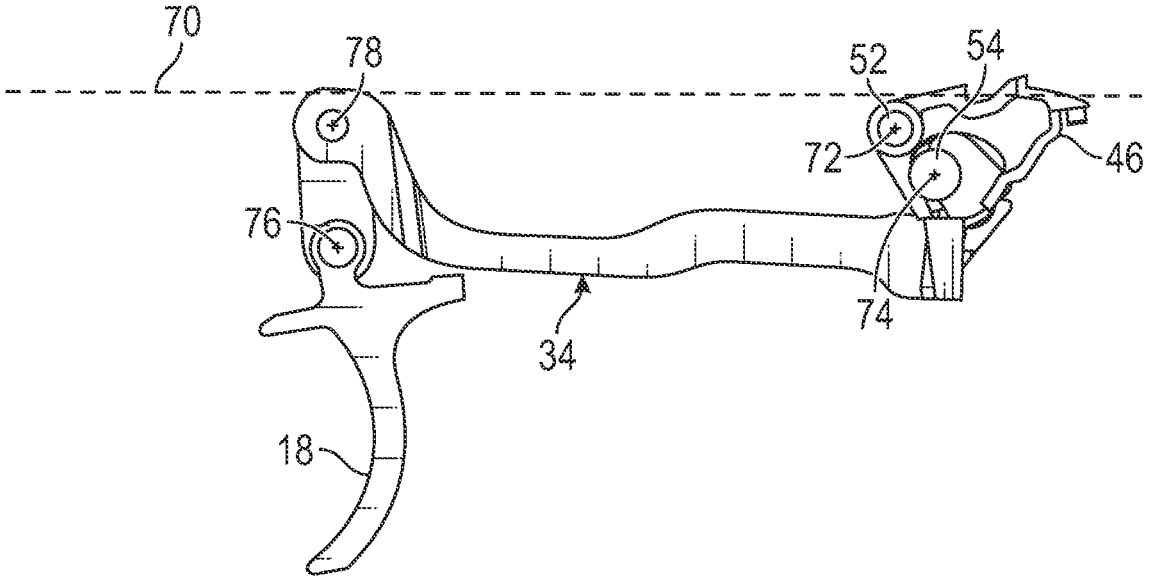
FIG. 8A is a left side view fire control components of the locking action firearm of FIG. 1 with the fire control unit and sear housing removed with the trigger pulled rearward relative to FIG. 7A.
Figure 8B:
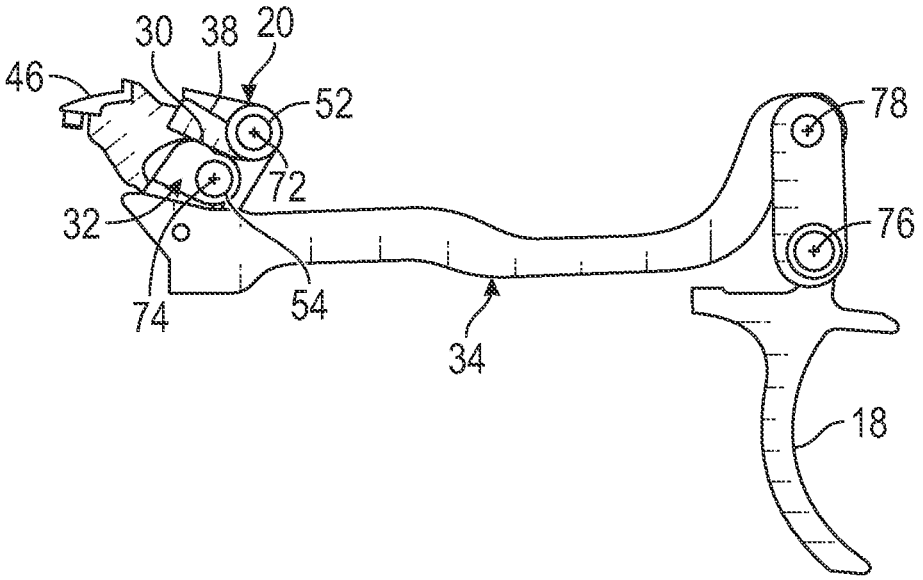
FIG. 8B is a right side view fire control components of the locking action firearm of FIG. 1 with the fire control unit and sear housing removed with the trigger pulled rearward relative to FIG. 7B.
Figure 9A:
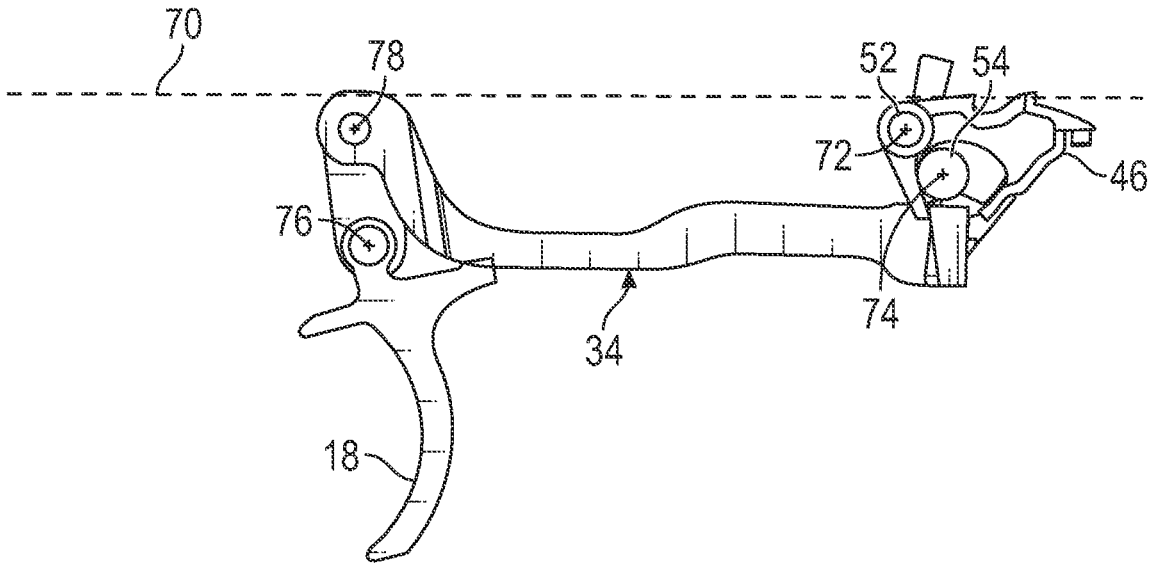
FIG. 9A is a left side view fire control components of the locking action firearm of FIG. 1 with the fire control unit and sear housing removed with the trigger pulled rearward relative to FIG. 8A.
Figure 9B:
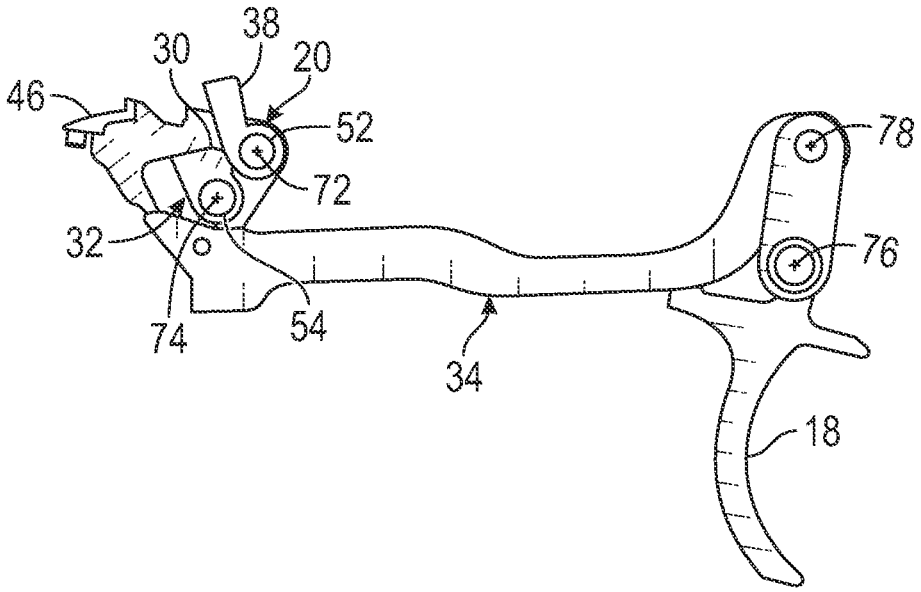
FIG. 9B is a right side view fire control components of the locking action firearm of FIG. 1 with the fire control unit and sear housing removed with the trigger pulled rearward relative to FIG. 8B.
Figure 10A:
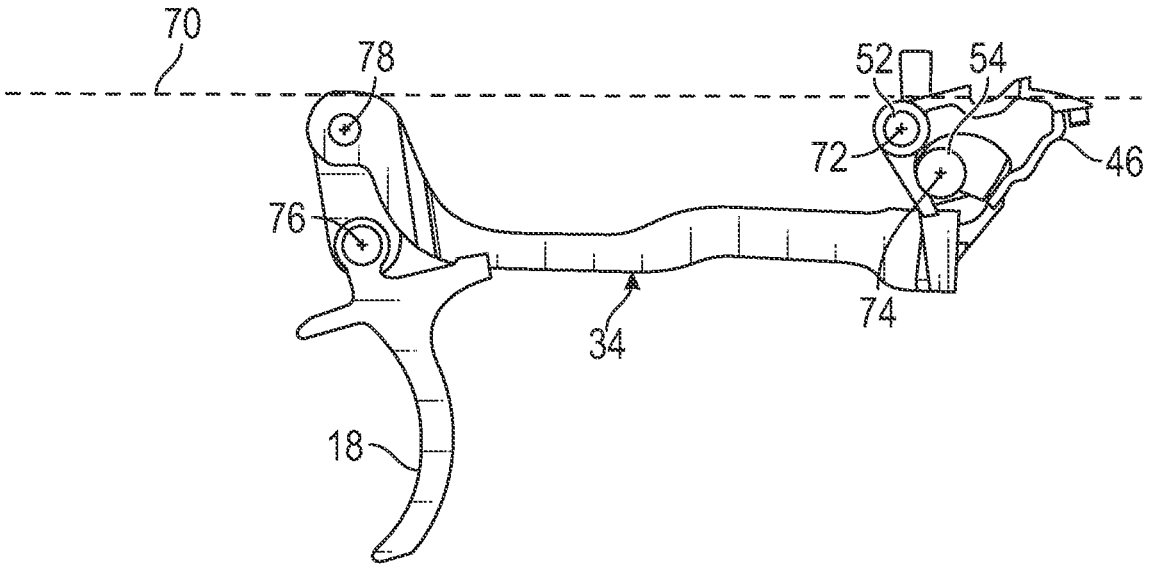
FIG. 10A is a left side view fire control components of the locking action firearm of FIG. 1 with the fire control unit and sear housing removed with the trigger pulled rearward relative to FIG. 9A.
Figure 10B:
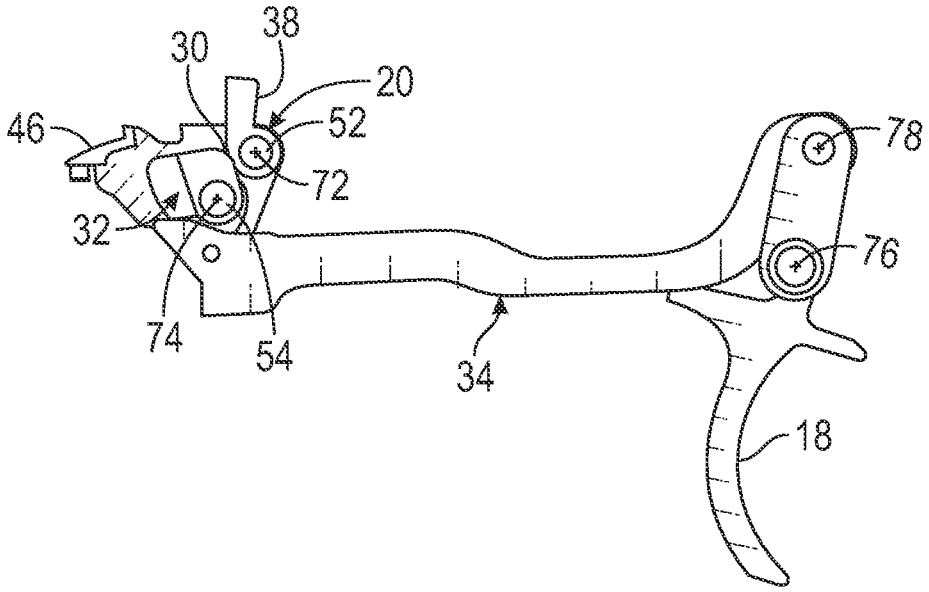
FIG. 10B is a right side view fire control components of the locking action firearm of FIG. 1 with the fire control unit and sear housing removed with the trigger pulled rearward relative to FIG. 9B.

FIGS. 1, 2 & 4 illustrate the improved locking action firearm 10 of the present invention. FIGS. 3 & 5 illustrates the fire control components of the improved locking action firearm 10 of the present invention. FIG. 6 illustrates an enlarged portion of the trigger bar of the improved locking action firearm 10 of the present invention. More particularly, the locking action firearm 10 has a frame 12, a barrel 14 connected to the frame, a reciprocating action element 16 operable to reciprocate with respect to the frame between a forward battery position and a rear recoil position, a trigger lever 18 connected to the frame and movable between a forward released position and rear actuated position, and a block element 20 movable between a rest position in which movement of the reciprocating action element from the battery position to the recoil position is enabled, and a blocking position in which the block element contacts the reciprocating action element to prevent movement of the reciprocating action element from the forward battery position to the recoil position in response to movement of the trigger lever to discharge the firearm.

The block element 20 is operably connected to the trigger lever 18 and moves based on the trigger lever position. Preferably, the block element moves to the blocking position in response to rearward movement of the trigger lever. Subsequently, the block element moves from the blocking position to the rest position in response to movement of the trigger lever to the released position. The block element 20 has a forward-facing block surface 38 when the block element is in the blocking position. The reciprocating action element 16 has a rearward facing catch surface 40 opposing the block surface when the reciprocating action element is in the forward battery position. In the current embodiment, the locking action firearm 10 is a pistol. The reciprocating action element can be a slide 22 or a bolt 24 reciprocating within a bolt passage 26 defined by the frame 12.

A trigger mechanism 28 operably connects the trigger lever 18 to the block element 20. The trigger mechanism includes a support surface 30 configured to contact the block element and secure the block element against recoil forces when the trigger lever is in the rear actuated position. The trigger mechanism has a mechanical advantage over the block element when the trigger lever is in the rear actuated position, such that recoil forces received by the block element do not transmit to the trigger lever. The trigger mechanism includes a pivoting element 32 operably engaged with the block element. The trigger mechanism also includes a trigger bar 34 connected to the trigger lever and operably engaged to the pivoting element. The trigger bar has a support surface 36 contacting the pivoting element and preventing pivoting of the pivoting element when the trigger lever is in the rear actuated position. The rear of the trigger bar (shown in FIG. 6) also includes arcuate surfaces 60, 62 and stepped surfaces 64, 66, 68.

A fire control unit 58 receives the trigger lever 18, block element 20, pivoting element 32, and trigger bar 34. The fire control unit also receives a locking pin 40, a trigger stop pin 42, a sear housing 44, a trigger sear 46, a safety lever 48, a disconnector 50, a sear pin 52, a safety lever pin 54, and a sear housing pin 56. The assembled fire control unit is received by the frame 12. The safety lever serves to activate or deactivate the block element so that, when the safety lever is active and the trigger lever is pulled, the slide 22 and barrel assembly are locked, but when the safety lever is deactivated and the trigger lever is pulled, the firearm 10 functions in a semiautomatic manner, and the locking mechanism is disengaged. The trigger sear can translate, rotate, or perform a combination of both movements in order to release a striker or to pull back and release a striker. The trigger sear is generally spring biased upward, depending on the trigger sear's orientation in relation to the striker, hammer, or other firing mechanism. The trigger bar connects the trigger lever to the trigger sear and several other trigger actuated parts. The trigger bar can be integral to the trigger sear in an alternative embodiment. The trigger bar is generally spring biased in the same manner as the trigger lever and can receive or be used to impute spring bias to the trigger lever.

The slide 22 or bolt 24 can reciprocate on the frame 12 or on guide surfaces and serve to contain the cartridge and pressure resulting from the firing of the cartridge. The slide or bolt can be spring biased forward to help them return to battery. The slide can be a SIG Sauer System-style handgun as shown, but can function in other ways such as a rotating bolt, a falling block, rotating chamber or barrel, blowback, or delayed blowback. The barrel 14 locks into the slide such that the barrel cannot be unlocked without displacing the slide or bolt. The barrel also contains the pressure resulting from discharging the cartridge and directs the projectile.

The frame 12 houses and partially constrains the motion of the trigger lever 18, houses the trigger bar 34, houses and partially constrains the motion of the trigger sear 46, includes rails or the provision for mounting rails that allow the slide 22 or bolt 24 to reciprocate to load or unload the cartridge or fired brass, and can include a camming pin or surface for aiding in the unlocking of the barrel or the provision for mounting such a pin or surface. The frame can also include holes, slots, or other provisions for mounting or positioning pins or other parts. The frame can be one piece or a permanent or non-permanent assembly of several pieces. The frame can also include provision for holding a feeding device and mounting accessories.

The blocking element 20 prevents the slide 22 or bolt 24 from moving such that they will unlock from the barrel 14. The blocking element may translate or rotate or perform a combination of both movements into a locked position when activated. The blocking element may contain a camming surface or gear teeth in addition to at least one surface to interface with the pivoting element 32. The blocking element is spring biased to the unlocked position. The blocking element may also include the provision to interface with other blocking elements in different locations on the firearm or on the other side of the firearm such that all of the blocking elements move in a coordinated, simultaneous manner.

The pivoting element 32 can may be actuated directly by the trigger lever 18 or indirectly by the trigger lever using the trigger bar 34. The pivoting element can include a camming surface or gear teeth or lugs to cause the translation or rotation or a combination of both movements of the pivoting element to lock the slide 22 or bolt 24. The pivoting element can contain geometry such that the pivoting element utilizes a mechanical advantage to impede the motion of the blocking element 20 once the blocking element is in the locked position. The pivoting element can also include geometry to allow the pivoting element to disengage from the trigger bar such that the pivoting element no longer moves when the trigger bar is actuated. The pivoting element can also include geometry to allow the pivoting element to disengage from the blocking element such that when the trigger bar is actuated and results in motion of the pivoting element, the pivoting element does not interface with the blocking element in a way which would result in motion. The pivoting element can be integral to the blocking element.

The pivoting element 32 creates a mechanical advantage because of the difference in distance between the pivoting element's pivot point and trigger bar 34 interaction and the pivoting element element's pivot point and blocking element 20 interaction. This distance difference can create a mechanical advantage of the pivoting element over the blocking element, although the pivoting element's primary purpose is not to create a mechanical advantage. The primary purposes of the pivoting element are to isolate the trigger bar from the blocking element so that resultant force from the blocking element is not transmitted to the trigger bar, to prevent potential timing issues between the blocking element and the trigger bar, and to make the extract force from the trigger bar's normal travel and convert it in a direction suitable for the blocking element.

If the blocking element 20 was a translating piece instead of a rotating piece, the pivoting element 32 would rotate to convert the forward motion of the trigger bar into upward motion for the blocking element. For the firearm 10, downward movement of the trigger bar 34 can cause the trigger bar to disconnect from the trigger sear 46, which would result in a dead trigger lever 18, but locked slide 22. If the pivoting element is attached to a safety lever 48, rotating the safety lever outside of the safety lever's normal range of motion would disengage the locking function and result in the firearm functioning like any other semi-automatic pistol.

The safety lever pin 54 directs the translational or rotational motion of the pivoting element 32 and/or the blocking element 20. The safety lever pin can also include a lever handle designed to be actuated by the user to selectively engage or disengage the pivoting element and/or the blocking element.

The parts of the firearm 10 are generally manufactured out of some kind of load bearing and wear resistant material such as steel, but some may be manufactured out of other materials such as plastics, polymers, composites, or nonferrous metals as appropriate. The parts may be manufactured by injection molding, casting, metal injection molding, stamping, fineblanking, waterjet cut, laser cut, machined, or EDM. Some of the parts, such as springs and linkages, can be wire drawn or extruded. The parts and/or springs may also be treated, coated, or processed to improve surface hardness, toughness, strength, to reduce friction, to prevent corrosion, or to improve aesthetics.

FIGS. 7A-10B show the sequence of operations of the firearm 10 from the left and right sides in four steps. The plane of the slide 22 is denoted by line 70. It should be appreciated that pivot points 72, 74, 76 are fixed pivot points and pivot point 78 is a floating pivot point that causes the trigger bar 34 to translate when the trigger lever 18 is pulled. The firearm 10 has two modes of operation. The first mode is when the blocking element 20 is activated by pulling the trigger lever. The safety lever pin 54 is actuated to the activated position, and the trigger mechanism 28 starts from the rest state. The trigger lever is then pulled by the user. Depending on the design of the firearm, the trigger lever movement pulls or pushes the trigger bar. The trigger bar then causes the pivoting element 32 to rotate. The pivoting element rotates and correspondingly rotates or translates the blocking element into the locked position so the blocking element impedes the reciprocating motion of the slide 22 or bolt 24. The pivoting element then cams the blocking element into place so the blocking element cannot move freely because of a mechanical advantage between the blocking element and the pivoting element. While depicted as a cam, gear teeth could be used instead. Both the blocking element in the pivoting element are depicted as moving rotationally, but one or both could experience translational movement. The trigger bar also acts upon the trigger sear 46 to depress the trigger sear and release the striker. This invention is also applicable to firearms where the trigger sear is integral to the trigger bar.

This sequence of operations is shown in FIGS. 7A-10B. When the slide 22 or bolt 24 is locked by the blocking element 20 as shown in FIG. 4, and the trigger sear 46 is depressed, the firearm 10 can discharge, but because of the blocking element, the slide or bolt will not recoil in a semiautomatic manner. When the trigger lever 18 is released by the user, the trigger lever and trigger bar 34 return to their at-rest positions, which releases the pivoting element 32. The pivoting element subsequently releases the blocking element and allows the blocking element to move into the unlocked position. The slide or bolt is then manually cycled by the user to extract and eject the fired shell and to load an unfired cartridge and reset the striker on the trigger sear 46. The cycle may then be completed again.

The second mode of operation occurs when the safety lever pin 54 is actuated to the deactivated position. The safety lever pin can be held in place with a detent. The safety lever pin then disengages the pivoting element 32 or the blocking element or both elements by rotating them beyond their normal range of motion. This can be accomplished by an interrupted circular profile in the pivoting element, which allows the pivoting element to pivot a specified amount when activated, but when deactivated, changes the at rest orientation of the pivoting element such that the pivoting element can no longer activate the blocking element, or such that the pivoting element is no longer activated by the trigger bar 34. This disengagement can also be accomplished by using a cutaway in the safety lever pin to displace a translating pivoting element or blocking element. This disengagement can also be performed by using a wedge feature on the safety lever pin to laterally translate the pivoting element so that the pivoting element can rotate or slide in the same manner the pivoting element could when activated, but the pivoting element cannot activate the blocking element.

With the blocking element 20 deactivated, the trigger lever 18 can be pulled by the user. This movement actuates the trigger bar 34 and causes the trigger sear 46 to release the striker. The cartridge is fired, and the barrel 14 and slide 22 or bolt 24 move rearwards before the barrel interacts with a camming pin or surface, which redirects the barrel so that the barrel unlocks from the slide or bolt. The slide or bolt then continues to recoil for a full range of motion and extracts and ejects the fired shell and loads an unfired cartridge. The striker is then retained by the trigger sear, and the firearm 10 is ready to fire again when the user pulls the trigger lever. With the blocking element deactivated, normal semiautomatic fire occurs. The blocking element can also be configured so the blocking element is activated every time the trigger lever is pulled, and the firearm has no provision for deactivating the blocking element by the user. This condition would cause the firearm to become a manually cycled bolt action firearm and prevent semiautomatic function.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of a locking action firearm has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A locking action firearm comprising:

a frame;

a barrel connected to the frame;

a reciprocating action element operable to reciprocate with respect to the frame between a forward battery position and a rear recoil position;

a trigger lever connected to the frame and movable between a forward released position and rear actuated position; and a block element movable between a rest position in which movement of the reciprocating action element from the battery position to the recoil position is enabled, and a blocking position in which the block element contacts the reciprocating action element to prevent movement of the reciprocating action element from the forward battery position to the recoil position in response to movement of the trigger lever to discharge the firearm.

2. The locking action firearm of claim 1 wherein the block element is operably connected to the trigger lever and moves based on the trigger lever position.

3. The locking action firearm of claim 1 wherein the block element is operably connected to the trigger lever and moves to the blocking position in response to movement of the trigger lever.

4. The locking action firearm of claim 1 wherein the block element is operably connected to the trigger lever and moves to the blocking position in response to rearward movement of the trigger lever.

5. The locking action firearm of claim 1 wherein the block element is operably connected to the trigger lever and moves from the blocking position to the rest position in response to movement of the trigger lever to the released position.

6. The locking action firearm of claim 1 wherein the firearm is a pistol, and the reciprocating action element is a slide.

7. The locking action firearm of claim 1 wherein the frame defines a bolt passage, and the reciprocating action element is a bolt reciprocating within the bolt passage.

8. The locking action firearm of claim 1 including a trigger mechanism operably connecting the trigger lever to the block element, the trigger mechanism including a support surface configured to contact the block element and secure the block element against recoil forces when the trigger lever is in the rear actuated position.

9. The locking action firearm of claim 8 wherein the trigger mechanism has a mechanical advantage over the block element when the trigger lever is in the rear actuated position, such that recoil forces received by the block element do not transmit to the trigger lever.

10. The locking action firearm of claim 9 wherein the trigger mechanism includes a pivoting element operably engaged with the block element, and the trigger mechanism includes a trigger bar connected to the trigger lever and operably engaged to the pivoting element.

11. The locking action firearm of claim 10 wherein the trigger bar has a support surface contacting the pivoting element and preventing pivoting of the pivoting element when the trigger lever is in the rear actuated position.

12. The locking action firearm of claim 1 wherein recoil forces received by the block element do not transmit to the trigger lever.

13. The locking action firearm of claim 1 wherein the block element has a forward-facing block surface when the block element is in the blocking position, and the reciprocating action element has a rearward facing catch surface opposing the block surface when the reciprocating action element is in the forward battery position.

* * * * *